United States Patent [19]

Belbel et al.

[11] Patent Number: 4,700,030

[45] Date of Patent: Oct. 13, 1987

[54] SWITCH DEVICE HAVING AN INSULATING SCREEN INSERTED BETWEEN THE CONTACTS DURING BREAKING

[75] Inventors: Elie Belbel, Epinay sur Seine; Christian Blanchard, Nanterre; André Haury, Le Raincy; Michel Lauraire, Courbevoie, all of France

[73] Assignee: La Telemecanique Electrique, France

[21] Appl. No.: 802,092

[22] Filed: Nov. 25, 1985

[30] Foreign Application Priority Data

Nov. 26, 1984 [FR] France ..... 84 17963

[51] Int. Cl.[4] ..... H01H 33/06

[52] U.S. Cl. ..... 200/151

[58] Field of Search ..... 200/144 R, 148 R, 148 A, 200/151

[56] References Cited

U.S. PATENT DOCUMENTS 4,562,323 12/1985 Belbel et al. ..... 200/151

*Primary Examiner*—Mark O. Budd

*Attorney, Agent, or Firm*—William A. Drucker

[57] ABSTRACT

An electric switch in which a screen is inserted very quickly between two contacts at the moment when they part. The energy of the arc generated between the contacts inside a volume surrounded by an insulating mobile sheath is used to heat gases released, and the resulting gas pressure displaces the sheath quickly, so that the arc passing through an opening in the sheath is sheared between the sheath and the housing. This type of switch is used to advantage in protection apparatus designed to respond to an abnormal increase of the current flowing in a circuit in which they are series mounted, and in switches where rated current is high.

23 Claims, 17 Drawing Figures

SWITCH DEVICE HAVING AN INSULATING SCREEN INSERTED BETWEEN THE CONTACTS DURING BREAKING

BACKGROUND OF THE INVENTION

1. Field of the Invention

The invention relates to an electric switch in which the arc generated between two mutually mobile contacts inside a chamber is sheared between two insulating walls, one of which belongs to an insulating screen that is quickly inserted between the two contacts, resulting in total insulation between them.

2. Description of the Prior Art

This type of switch, which can be used to advantage in automatic or manual opening protection devices, is described for instance in the French patent application No. 83 01749, filed on Feb. 4, 1983 by the Applicant. These switches can also be used in circuit opening apparatus with high rated current.

In some of these known switches where the screen movement is caused by the release of energy accumulated in a spring at the moment the contacts part,.screen motion speed varying as an increasing function of current level may be wanted, to avoid quick current rise. Besides, a movement energy that needs no mechanical setting or resetting after automatic opening is often desirable.

In other screened switches, where screen motion is driven by an electro-magnetic striker supplied by the current flowing in the switch, the speed imparted to the screen, although to an extent it is in increasing function of the current flowing in the magnetic coil, cannot exceed a certain threshold owing to the magnetic saturation that develops.

In these two types of known devices, screen velocity could be increased by increasing the potential energy of a previously set driving spring, to be released either by the movement of the contacts or by a magnetic coil tripping device; however, this would require a more costly and more delicate resetting system, owing to the amplitude of the forces involved and the wear of the mechanical parts controlling them.

In any case, as high a pressure as possible should be maintained for some time in a switch arc chamber, in order to take advantage of the favourable effect of pressure on arc voltage.

SUMMARY OF THE INVENTION

The aim of the invention is to improve the operation and final insulation level of a screened switch by maintaining as high a pressure as possible within the arc chamber for some time after contact opening, without any risk of damaging the parts in the chamber, and to drive the screen with an energy which on one hand is not limited when the current exceeds a given threshold and on the other hand increases constantly if the arc is not quenched quickly.

With the invention, the aim is attained thanks to an opening in the wall of the mobile screen, which lets the mobile contact through in the closed position, and is mechanically coupled to an insulating part which, together with the housing, encloses a variable volume in which the fixed contact is assembled, so that the gas pressure caused by the energy of the arc at the moment of contact parting exerts a force on the insulating part which causes the screen to move towards a position in which the arc is sheared in this opening and against an insulating surface located opposite thereto, when the mobile contact withdraws therefrom.

A switch is already known, e.g. under U.S. Pat. No. 2,116,673, wherein a mobile insulating envelope slides around a fixed insulating portion supporting two fixed contact parts that can be linked together by a third mobile contact part which is solidly attached to the sheath, so that the pressure increase due to the arc, which arises upon opening, tends to repel the envelope, and to accelerate the movement of the third part. In this switch, which is not designed for use as a protective device and where no care is taken to ensure high-quality insulation between switch contacts after opening, there is no screen to divide the arc chamber in two sealed-off volumes, whereas the initial movement of the insulating envelope, and therefore initial opening speed, do not result from arc inception, but instead from a force applied on the said envelope.

BRIEF DESCRIPTION OF THE DRAWINGS

The invention may be understood better with the following description.

In the drawings attached.

DESCRIPTION OF THE PREFERRED EMBODIMENT

Figure 1:
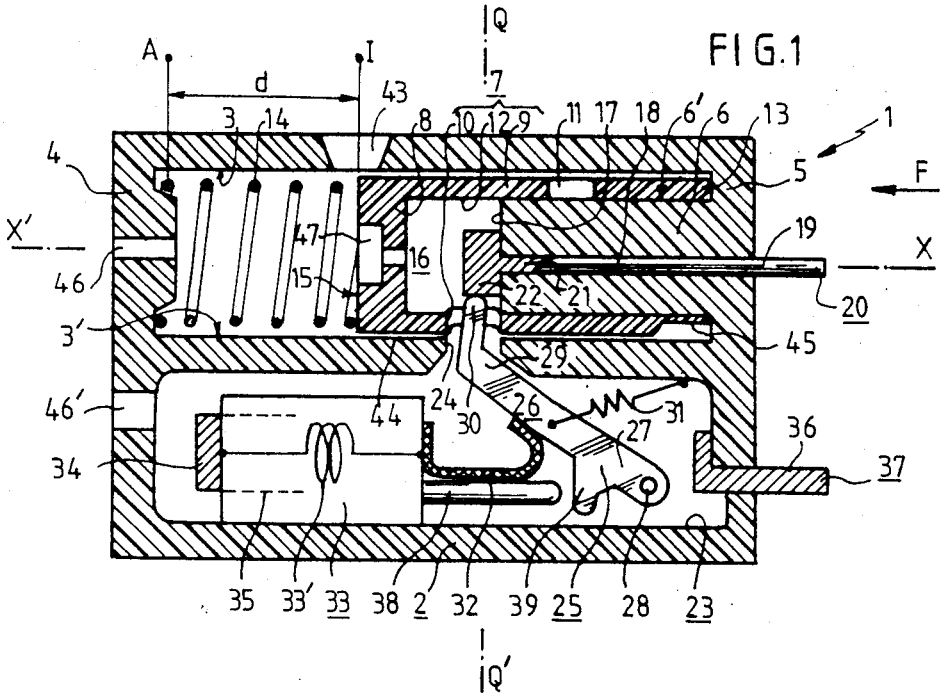
FIG. 1 shows a first implementation of the switch, in a cross-section on a plane PP' parallel to the screen motion direction.

Switching device 1, as illustrated in FIG. 1, comprises an insulating housing 2 in the top of which there is a cylindrical seating 3, centered on XX', closed at one end by a partition 4 and at the opposite end by a bottom 5 which has a prolongation or cylindrical portion 6 with a smaller diameter which is coaxial to XX' and which extends axially along a fraction of the length of the seating.

A sheath 7 made of an insulating material with a bottom 8 and a cylindrical skirt 9, has an internal surface 12 which slides with a close fit on surface 6' of portion 6; the length of this sheath is such that, when the edge 13 of the skirt bears on the bottom 5, e.g. pushed by a weak return spring 14 inserted between the bottom and partition 4, a clearance "d" remains between the front face 15 and this partition.

In the idle position I of the device, as illustrated in FIG. 1, an opening 10 provided in skirt 9 opens into a volume 16 enclosed between the bottom 8 and a front face 17 of portion 6. In the idle position, a hole 11 in skirt 9, e.g. diametrically opposite, is located opposite the external cylindrical surface 6' of portion 6.

A conductive part 18, which passes longitudinally through portion 6, has a connection terminal 20 for an electric circuit on one end 19, and on the other end 21 a fixed contact 22 which is housed in the volume 16 opposite opening 10.

A mobile contact 25 is fitted in a cavity 23 of the housing, located near the seating 3 and connecting with the latter by a passage 24 in front of opening 10 in the idle position.

Figure 2:
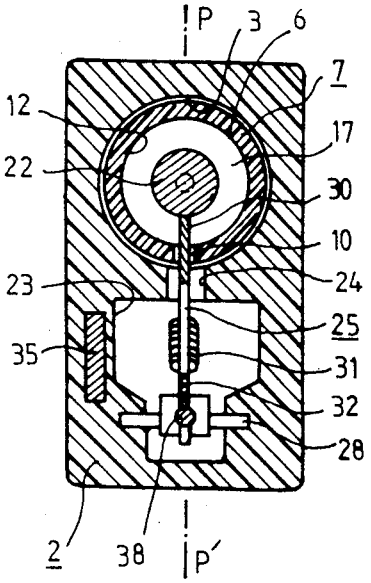
FIG. 2 is a side view of FIG. 1, cut away by a plane QQ'.

This part is shaped e.g. as a lever 26 which oscillates at one end 27 on a pivot 28 assembled in the housing and which at the opposite end 29 has a mobile contact 30 which enters the passage and the opening and is passed against fixed contact 22 by a spring 31: see also FIG. 2.

In the embodiment illustrated in FIG. 1, where the switching device is used as a circuit breaker, a flexible conductive braid 32 connects mobile part 25 to a magnetic device 33, which is sensitive to a specific overcurrent, in turn connected to one end 34 of conductor 35, the opposite end 36 of which is the second terminal 37 of the apparatus: see also FIG. 2.

This magnetic device 33 features for instance a coil 33' indicated schematically and a pushrod 38, located opposite heel 39 of lever 26 and thus exerts on the latter a counter-clockwise torque exceeding the torque of spring 31 when current flowing from terminal 20 to terminal 37 is excessive. Pushrod 38 can be connected to a frame, armature or core associated with the coil, or be a part of an elastic mechanism the energy of which is released by the action of the coil on a safety lock.

A vent 43 that opens seating 3 to the atmosphere coincides with hole 11 when the sheath reaches an intermediate position between the idle position and operating position A, so that cavity 16, the volume of which has then increased, opens to the atmosphere.

Figure 3:
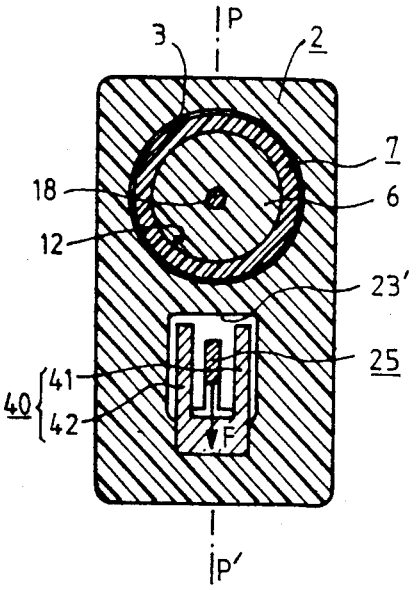
FIG. 3 is a side view of FIG. 4 cut away by a plane RR'.
Figure 4:
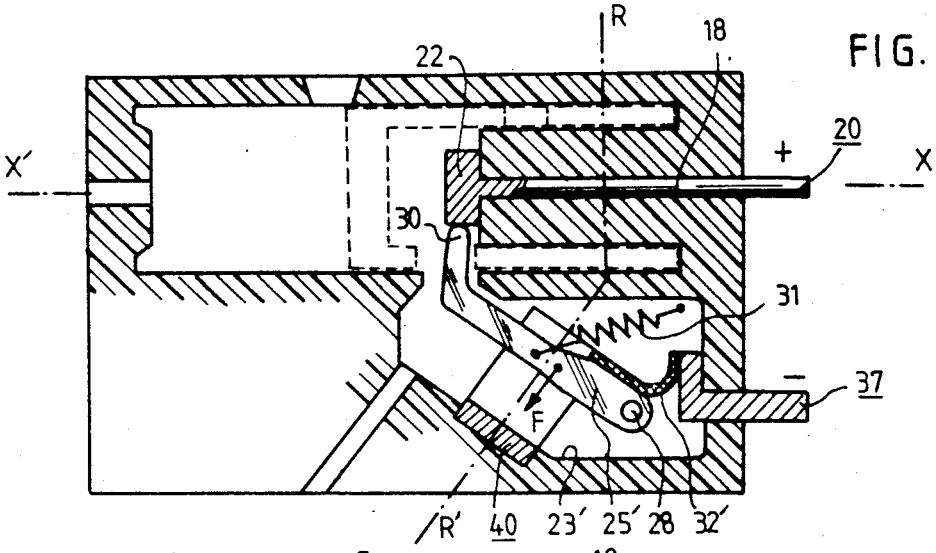
FIG. 4 shows a second implementation of the switch, in a cross-section on a plane PP' parallel to the screen motion direction.

In the embodiment shown in FIG. 3, where the switch is used as a short-circuit current-limiting device and where parts with the same functions have the same reference numbers, a fixed magnetizable U-shaped part 40 has two arms 41, 42 which surround lever 26 laterally; see also FIG. 4; this part, when very high current flows in the lever, exerts on the latter forces F which cooperate with electro-dynamic forces prevailing between conductor 18 and lever 26 to tilt the lever counter-clockwise.

Operation of the switches in both types of devices is identical, and includes two successive phases: when the overcurrents appear, owing to a fault on the line in which the device is series-mounted, the mobile contact 30 is firstly separated from fixed contact 22 on which it bears, either by forces F, or else by pushrod 3B.

During this very fast movement, contact 30 withdraws from opening 10, and the arc that arises between the contacts as soon as they part causes a very rapid pressure rise in the volume 16, which moves the sheath very fast towards the left in FIGS. 1 or 4.

Owing to a very slight clearance between seating 3 and the outer surface of the sheath, the arc that passes through opening 10 and is slightly drawn out by the motion of the opening is then sheared when the opening meets the surface 3' of insulating area 44 near passage 24 in seating 3.

As the sheath continues to move towards the left, the hole 11 which at that moment has just left portion 6, comes into alignment with vent 43, so that pressurized gases are vented to the atmosphere. An outlet 46' can also vent chamber or cavity 23 to the atmosphere.

Figure 5:
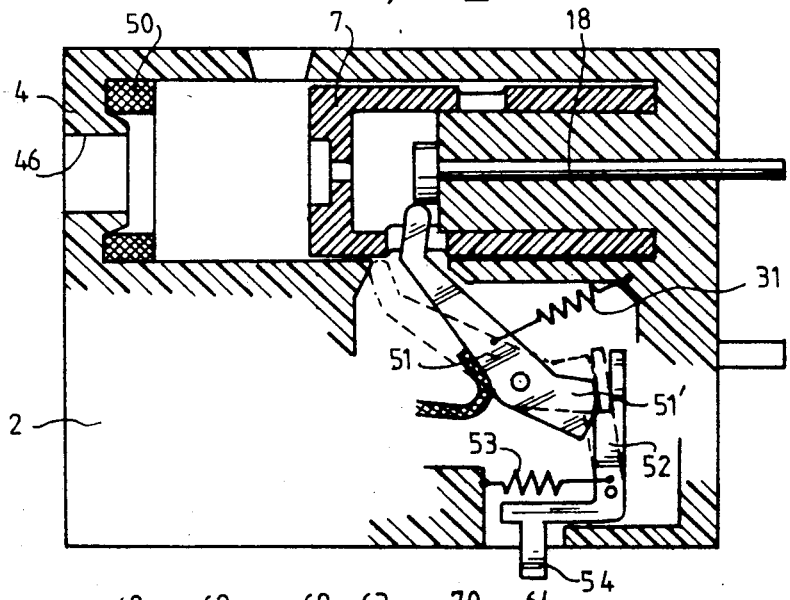
FIG. 5 shows a schematic cross-section of a switch such as the one in FIGS. 1 or 4, in which ancillary devices are used.

After opening, when a contact lever, e.g. 51 belonging to an apparatus such as that previously described, arrives at a position illustrated in FIG. 5, a lock 52, operated by a spring 53, cooperates elastically with an extension 51' of the lever and keeps it in a tripped position removed from the sheath, as shown in dashed lines. This position may be modified subsequently by operating, e.g. manually, a pusher 54 of the lock, to return the switch to its closed position.

In the embodiments shown, owing to the overlap between skirt 9 and the outer surface of portion 6 and the fact that conductor 18 is enclosed inside this portion, the arc cannot find a path to strike again between the two contacts and hence total insulation is not only immediately ensured but in addition is maintained between the contacts after opening.

After circuit opening, it may be reclosed either by separating contact 30 from a catch 45 on skirt 9 with which it was cooperating in position A (by means of a device not drawn) and in this case the sheath is pushed back to the right by spring 14 so that mobile contact 30 can enter opening 10 again, or else a force can be exerted towards the right (by means of other devices not drawn) on the sheath to release contact 30 from catch 45.

High sheath motion speed, which is necessary for good circuit breaking quality, may damage the housing through impacts on partition 4. Therefore it may be advisable to slacken sheath speed at the end of its run avoiding any bounce, or else to decrease the mean effective gas pressure. Combining both measures can also be given consideration.

The motion can be buffered either by providing for measured friction of the sheath on its seating, if necessary associated with suitably elastic spring 14, or by providing a calibrated outlet, such as 46, in partition 4, to give the air volume ahead of the sheath a similar property, or else by inserting an elastomer shock-absorbing cushion, such as 50, between the sheath and the partition: see FIG. 5.

The mean effective pressure of the gas in volume 16 can be decreased either by providing for a calibrated outlet 47 at the front end 8 of the sheath, or by designing outlet 11 and vent 43 with a specific position and size.

Outlets 46 and 47 could also be fitted with valves, known as such, designed to open automatically when there is a certain pressure drop between their input and output.

In the implementation illustrated in FIGS. 1 to 4, the sheath is cylindrical, requiring the use of angular positioning means (not shown) so that the openings, holes and passages keep their matching positions.

If the sheath is given a prismatic section, which is easy by molding, the positioning devices are no longer required.

Lastly, guiding and relative seal between the sheath and the seating can be ensured either by adjusting the internal surface 12 of skirt 9 on the external surface 6' of portion 6, or else by adjusting the outer surface of skirt 9 on the surface 3' of seating 3; calibrated leaks between these mutually mobile parts cannot be considered unless they do not impair the quality of the insulation between contacts after opening.

Although the embodiments illustrated concern protective switches where automatic opening is triggered by devices responding to an overcurrent in the circuit, obviously this type of switch could also be used for on-load opening of circuits which gives rise to a considerable arc between the contacts. Sudden contact opening devices, preferably applied to the mobile contact, such as those using the energy stored in a spring, could then be tripped and reset manually.

The switch described above has the advantage over those known in the previous state of the art that the energy that causes screen motion increases, either if the latter slows down, e.g. if abnormal friction occurs, or if the arc energy increases.

The exceptionally good results that can be obtained with a switching device as described can be illustrated by the following data: opening a presumed 10 kA short-circuit current under a single-phase 600 V r.m.s. voltage limits this current to 3.5 kA peak in 1 millisecond with an arc voltage up to 980 V.

Figure 16:
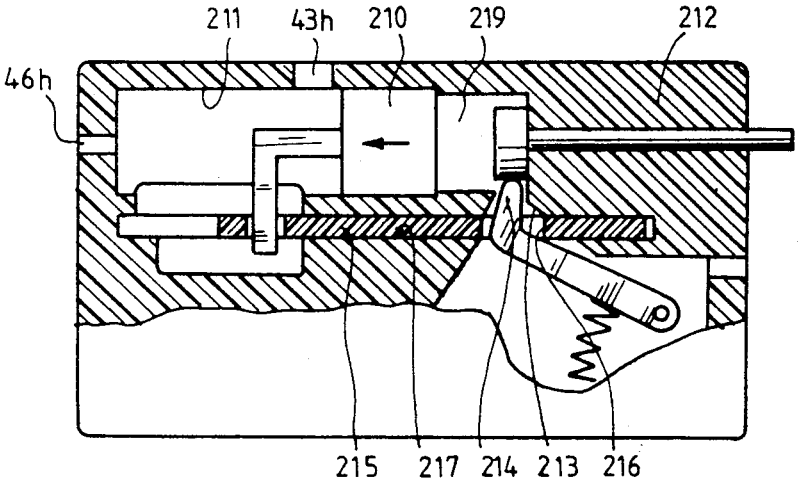
FIGS. 16 and 17 show a longitudinal section of two switching devices in which an insulating screen designed to shear the arc is driven by means of a piston pushed by gas expansion following contact opening.
Figure 17:
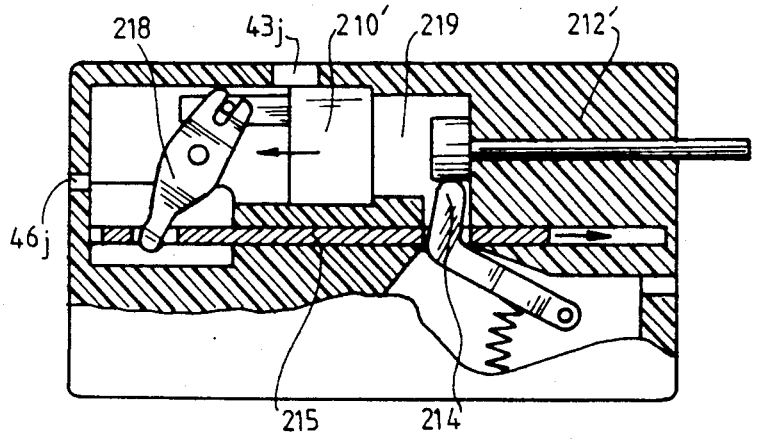

Of course the switching device just described can be modified and still remain within the scope of the invention; e.g. (see FIG. 16) the insulating mobile part could be shaped as a piston 210 enclosing between itself and the housing 212 a variable volume 219 moving inside a cylinder 211 of housing 212 with an opening 213 to let mobile contact 214 through and so that the latter meets a fixed contact 220, and an insulating screen 215 with an opening 216 driven by this piston in an adjusted parallel seating 217 could shear the arc by blinding this opening hermetically; a lever 218 pivoting in housing 212' can be used to join the piston and the screen to provide some dynamic balancing (see FIG. 17).

Figure 6:
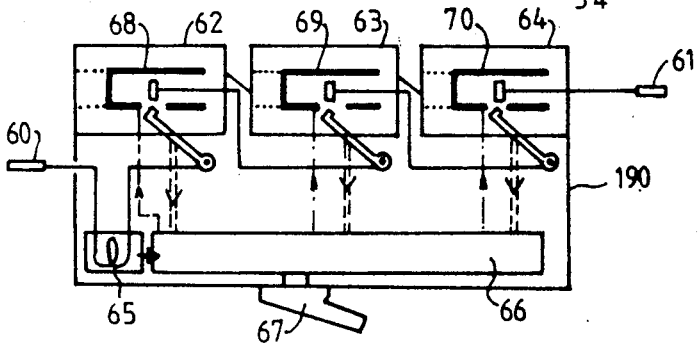
FIG. 6 is a diagram of a circuit breaking apparatus involving several switches.

Lastly, if the switch just described is to be applied to opening a medium-voltage circuit, several switches 62, 63, 64 tripped automatically and simultaneously, e.g. by means of a coil 65 connected in series, acting on a suitable elastic mechanism 66 that operates them in parallel, can be assembled electrically in series between two terminals 60, 61 in a unit housing 190: see FIG. 6. A manual resetting device 67 for instance makes it possible to return sheaths 68, 69, 70 and the mechanism to their original position after a fault.

In the embodiment shown in FIG. 1, coil 33' can trigger a striker 38 that first causes direct opening of the contact.

Figure 8:
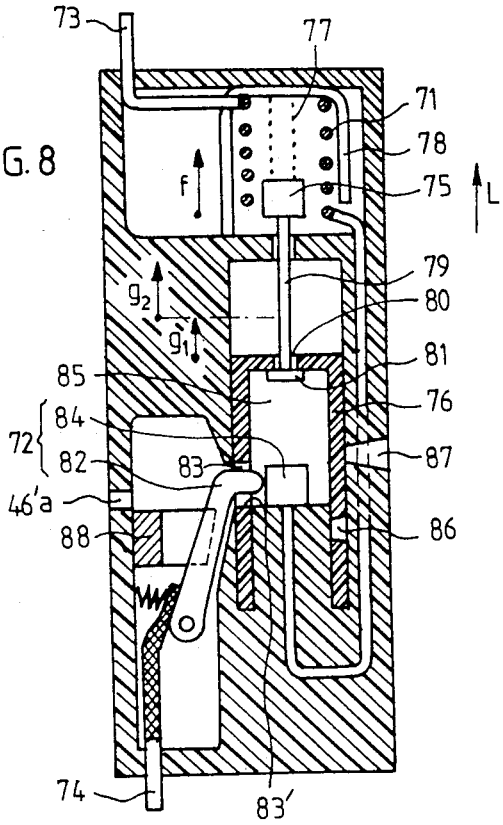
FIGS. 8 and 9 show a cross-section of switches featuring magnetic devices designed to impart an initial speed to sheath-shaped screens.

In the embodiment illustrated in FIG. 8, a coil 71, associated for instance with a magnetizable yoke 78, is series mounted with a switch 72 similar to those described above and connected between two terminals 73, 74; this coil cooperates with a plunger core 75 placed coaxially to a sheath 76. The plunger core, the resting position of which is held by a spring 77, is bonded to a shaft 79 which passes through an opening 80 in the bottom of the sheath and is retained inside the sheath by a head 81 bigger than the opening.

The idle position of the switch shown in FIG. 8 shows that when a high overcurrent appears between terminals, the striker can move a distance f and drive the sheath in the direction L. After the sheath has covered an initial distance g1, the mobile contact 82 inserted through opening 83 in the sheath then parts at very high speed from the fixed contact 84 through the bottom edge 83' of this opening. The electric arc generated, before being sheared, raises the pressure in the internal volume 85, and this pressure impels the sheath in the direction L for another distance g2 before the core has completed its stroke.

The free movement of the sheath along the shaft enables the sheath to move faster than the shaft.

As a result the advantages of very fast screen movement on a short distance can be combined with those of pressure-induced speed on a longer stroke.

As in the previous examples, the sheath has at least one decompression opening 86 which coincides with outlet 87 in a particular position.

A U-shaped magnetizable structure 88 can be usefully associated with lever 89 which bears the mobile contact when the switch is used in a protective device against any type of short-circuit.

This embodiment provides the same switching system both with the fast current-limiting breaking capacity required for automatic opening on heavy short-circuits (owing to the action of structure 88, or the effect of the electro-dynamic repulsion loop effect that separates mobile contact 82 from fixed contact 84 in this case) and with fast enough breaking capacity to open lesser short-circuits efficiently on an impedant load, enabling a coil 71, a core 75 and a yoke to be used at their saturation limit.

Figure 9:
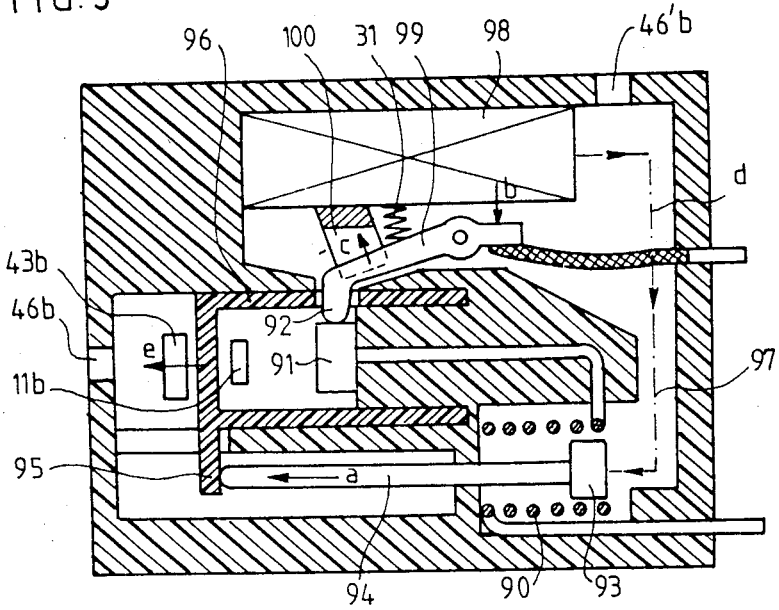

In a variation of this embodiment, shown in FIG. 9, a coil 90, mounted in series with the switch contacts 91, 92, cooperates with a plunger core 93, an extension of which 94 moves a distance a to strike a shoulder 95 of a sheath 96 assembled alongside; the same striker, by the movement d, d', triggers a transmission 97 to an elastic energy accumulator 98 associated with mobile contact lever 99, and imparts fast movement b to the latter; a magnetizable U-shaped structure 100, the arms of which surround the lever, exerts a pull c on the latter in the opening direction. The displacement e of the sheath is caused by the appearance of the electric arc.

Depending on overcurrent levels, the order of these actions is not the same.

When the current is comprised between three and fourty times the rated current, d and b occur before e, whilst for higher current levels, a may occur before b and e; lastly, for maximum current surges, c occurs before e, a and b.

Figure 12:
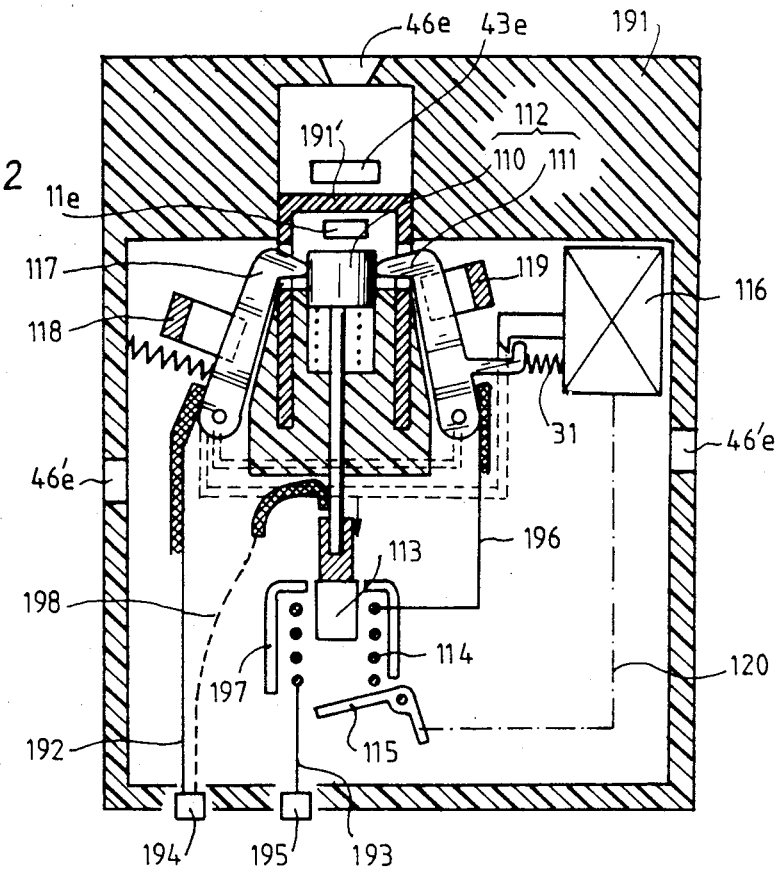
FIG. 12 shows a switching apparatus where a specific opening function can be assigned to each of the two mobile contacts, with a single sheath.

A refinement applicable to all the types of embodiments (but more particularly warranted when the speed provided by a magnetic core is desired) is shown in FIG. 12. In a housing 191, fixed contact 110 cooperating with at least one mobile contact 111 of a switch 112 can induce opening by withdrawing axially owing to the action of a plunger core 113 to which it is coupled. The action of this plunger core, surrounded by a coil 114 in series with the contacts, can be completed by the action of a magnetizable frame 115, associated with a yoke 197, the movement of which triggers—through a transmission 120—a force accumulator 116 designed to displace mobile contact 111. When a second mobile contact 117 is associated with fixed contact 110 (whether the latter withdraws or not) a U-shaped magnetizable structure 118 can be fitted around it so that opening occurs at a current level different from the level that attracts the core. To allow movement of the common sheath 191' when only mechanism 116 is active, a mechanical bond 117' is established, either between mobile contacts 111, 117, or else between lever 117 and the mechanism 116: see dashed line. A second U-shaped piece, 119, could also be fitted around contact lever 121 if there is no second contact 117. If there is only one single mobile contact, the electric circuit, which is closed in the first case by conductors 196, 192 and 193 leading to terminals 194, 195, would be closed by conductor 198 (dotted line).

Figure 7:
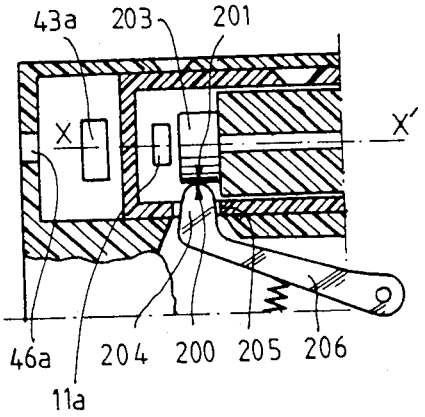
FIG. 7 is a detailed cross-section of the contact area in the switch.

All the embodiments drawn show bearing surfaces 200, 201 of fixed contacts 203 and mobile contacts 204 located near opening 205 through which the mobile contact lever 206 passes, and moreover are parallel to sheath centerline XX': see FIG. 7. These provisions, which ease the passage of the mobile contact through the opening when gas pressure impels the sheath, whereby the mobile contact, and therefore the arc, follow a path practically perpendicular to the XX' axis, can vary slightly depending on the relative velocities of the two mobile contacts and in particular embodiments; these provisions can be combined attractively with the position of the mobile contact lever pivoting axis to form a current loop with the fixed contact.

The embodiments described hereabove, and the name of "sheath" given to the mobile insulating part used to ensure arc shearing may be taken to imply that the latter is necessarily hollow or tubular in shape with a continuous skirt.

Figure 10:
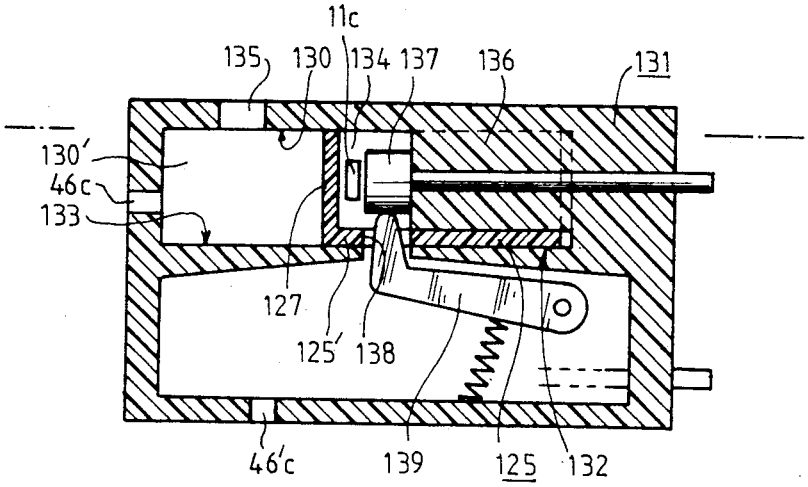
FIGS. 10 and 11 respectively illustrate a longitudinal cross-section and a partially cut away perspective of a particular implementation of the sheath.
Figure 11:
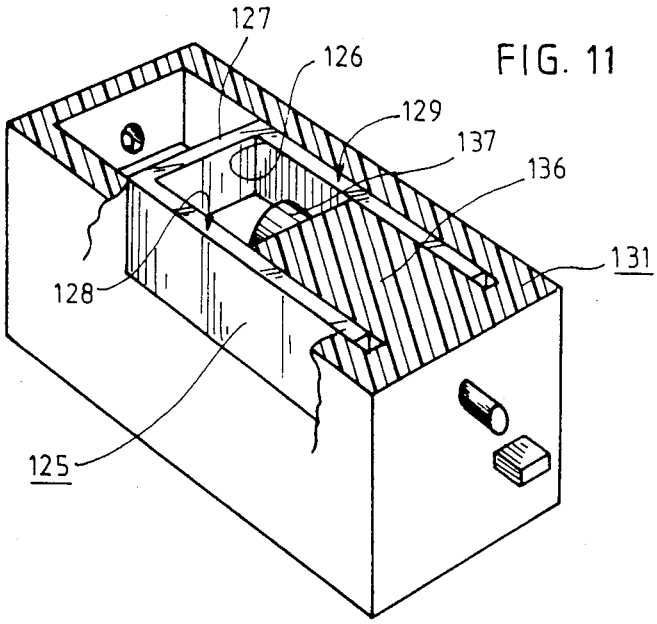

In fact, the embodiment shown in FIGS. 10 and 11 shows that although they are preferred because they make it easy to obtain an airtight fit between the moving parts, the previous configurations are not exclusive. An open sheath such as 125 with a discontinuous skirt due to the presence of an indentation 126, moving inside a compartment 130' in housing 131 can perfectly fulfil the same functions as above, if its bottom 127 and its sides 128, 129 are fitted closely enough on the closing surface 130 belonging to housing 131. This layout has the additional advantage that it establishes a perfect fit between the outer surface of the sheath 132 and the mating compartment surface 133 when the internal pressure rises, which is beneficial for efficient arc shearing and for the total insulation that must follow. The inner chamber 134 is decompressed when the bottom 127 arrives in front of opening 135 in the housing. Here again, a portion 136 of the housing 131 bears the fixed contact 137, whereas the opening 138 in the side 125' of the sheath parallel to the direction of the movement lets mobile contact 139 through.

Series mounting of several switches inside a housing is ensured in FIG. 6 by a series of individual switches of the same type; these switches can be any one of the types of implementation illustrated.

Arc voltages can also be cascaded by combining two breaking zones within a particular switch, as shown in figure 12.

Figure 13:
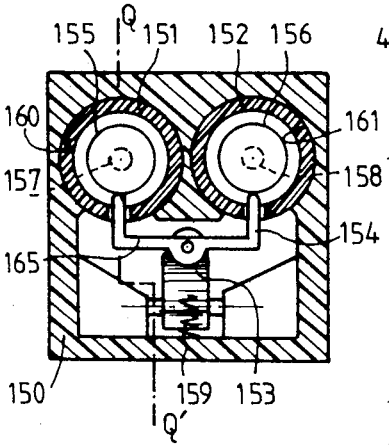
FIGS. 13 and 14 show a transversal cut-away by plane TT' and a longitudinal cutaway by broken plane QQ' respectively, of a dual switch with two parallel sheaths.
Figure 14:
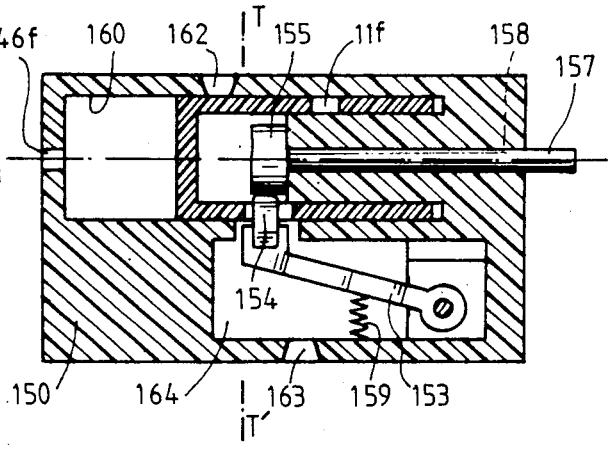
Figure 15:
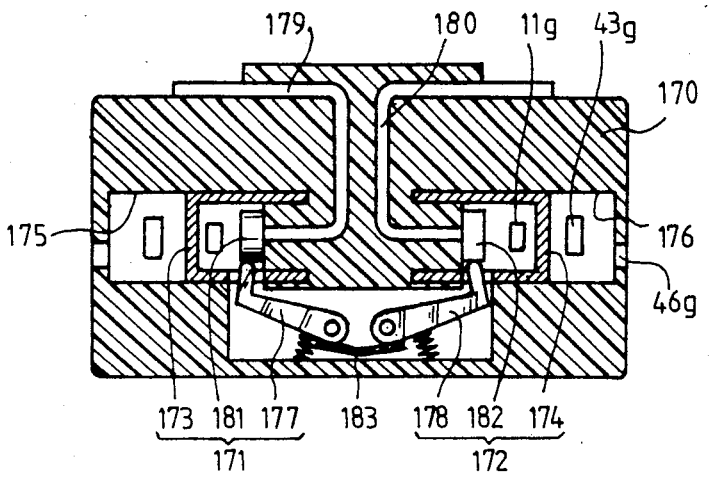
FIG. 15 shows a longitudinal section of a dual switching device using two coaxial sheaths.

Lastly, it is possible to combine two switches so that they are series mounted and yet have a smaller overall size than two independent switches, as shown in FIGS. 13, 14 and 15.

In FIGS. 13 and 14, two cylindrical sheaths 151, 152 sliding in two seatings 160, 161 of a same body 150 are placed side by side so that their centerlines are parallel. A single mobile lever 153, restrained in the closing direction by a spring 159, has a mobile contact 154 on its free end which is able to meet both fixed contacts 155, 156 simultaneously; this mobile contact preferably features known means designed to provide it with a degree of freedom that enables it to be oriented as a contact bridge 155. This mobile contact does not need to be connected to a conductive braid, since the current flows through a first conductor 157 leading to the first fixed contact 155 through mobile contact 154 and then through conductor 158 leading to fixed contact 156.

As before, a chamber 164 housing the mobile contact lever 153 and the seating 160 in which the sheath moves, features outlets 163–162 to decompress the gase released and/or heated by the arc. Devices required to open the mobile contact and which can be chosen among the previous examples have not been shown in these figures. However, since there is no current in lever 153, it will not be possible to associate a U-shaped magnetizable structure with it; a structure of this type should cooperate here with the horizontal arm 165 of the mobile contact bridge.

FIG. 15 illustrates a housing 170, with a combination of two separate switches 171, 172 each with its own sliding sheath, 173 and 174 respectively, located in coaxial seatings 175, 176 and their mobile contact levers, 177, 178 respectively. The sheaths move in opposite directions, and as a result improve the dynamic balance of the housing. Insulated conductors 179, 180, connected to fixed contacts 181, 182, undergo a parallel deviation from the centerline after following two coaxial directions: a conductive braid 183, which connects the two mobile contact levers 177, 178 permanently, closes a looped current circuit particularly designed to generate electro-dynamic forces that separate the contact levers when very high currents appear in the circuit. Here again, ancillary parts which also cause contact lever opening for different overcurrent levels have not been shown for the sake of simplification.

In a number of the embodiments shown, the same reference numbers, in some cases with alphabetical indexes, have been used to identify devices used for the same purpose; this is namely the case for outlets and vents designed to exhaust the gases present ahead of, or inside the sheaths as shown in 46, 46', 43 and 11 in FIG. 1.

We claim:

1. An electric switch comprising:

a casing provided with an insulating partition which delimits inside said casing first and second arc chambers and which comprises an aperture;

first and second contacts respectively housed in said arc chambers, said contacts being mobile with respect to each other between a closed position and an open position, said second contact passing through said aperture in said closed position, and a thin mobile insulating screen mobile in a determined direction and adapted to be inserted rapidly between the contacts when said contacts are passing from said closed position to said open position so as to cause the arc arising between said contacts to be sheared between said insulating partition and said screen and the two arc chambers to be insulated from each other.

wherein said mobile screen is mechanically coupled to an insulating piece which encloses, together with the casing, a variable volume such that the gas pressure raised by the arc energy when the contacts are passing from said closed position to said open position, exerts a force on the insulating piece that moves the screen in front of the aperture, causing the arc to be sheared.

2. An electric switch according to claim 1, wherein the mobile screen is bonded to said insulating piece and comprises a side provided with a first opening through which the mobile contact passes in the closed position, said mobile screen enclosing, with sides of the casing, a variable volume in which the first contact is housed, so that the pressure of the gases heated by the arc at the moment when the contacts pass from said closed position to said open position and exerts a force on the screen that causes it to move in front of the aperture and therefor said arc to be sheared.

3. An electric switch according to claim 2, wherein said screen and said insulating piece form a sheath which contains said variable volume, said sheath having a bottom which is prolonged by a continuous skirt which is parallel to said determined direction and which slides on guiding surfaces which are part of the casing.

4. An electric switch according to claim 3, wherein the guiding surfaces which are part of the casing are placed on an insulating portion that protrudes inside the sheath and at one and carries the first contact.

5. An electric switch according to claim 3, wherein the guiding surfaces which are part of the casing are placed in a seating in which the sheath slides, whilst the first contact is fastened to one end of an insulating portion of the casing that protrudes inside the sheath.

6. An electric switch according to claim 2, wherein the variable volume is contained inside a sheath the bottom of which is prolonged by a discontinuous skirt which is parallel to said determined direction and which slides on the surfaces of a seating which is part of the casing.

7. An electric switch according to claim 6, wherein the first contact is fastened to one end of an insulating portion which is part of the casing and which protrudes inside the sheath.

8. An electric switch according to claim 3, wherein the continuous skirt features a second opening that comes in front of a vent provided in the casing so that the gases contained within the volume can be exhausted to the atmosphere in a particular position of the sheath.

9. An electric switch according to claim 6, wherein the discontinuous skirt features a longitudinal indentation that comes in front of a vent provided in the casing in a particular position of the sheath.

10. An electric switch according to claim 5, wherein a conductor connected to the first contact runs parallel to said determined direction inside the insulating portion, whereas the second contact is carried by a support which forms a current loop with this conductor.

11. An electric switch according to claim 10, wherein pressure limiting devices are positioned on the sheath and on the casing respectively in such a way that the pressure in the variable volume and in the seating respectively does not exceed a present value.

12. An electric switch according to claim 11, wherein the second contact is assembled on a pivoting lever which is restrained in the closing position by a return spring and upon which antagonistic forces developed by an overcurrent-sensing device are brought to bear if an overload appears in its circuit.

13. An electric switch according to claim 12, wherein said sensing device includes a coil in which the switch current flows, and a magnetic core or frame.

14. An electric switch according to claim 12, wherein the said sensing device includes a U-shaped magnetizable part, the arms of which surround the contact lever.

15. An electric switch according to claim 13, wherein a mechanical energy accumulation device is released by a coil and core sensitive device and applies forces on the lever which are antogonistic to those developed by a contact pressure spring.

16. An electric switch according to claim 13, wherein the sensing device includes a coil and a magnetic core which is coupled to the sheath in order to drive the latter through a first part of its stroke during which the second contact is separated from the first contact by a sheath surface, while the sheath continues its stroke without being coupled to the magnetic core.

17. An electric switch according to claim 13, wherein the magnetic core of the coil is coupled to a fixed contact which can withdraw parallel to the determined direction, so as to interrupt the contact with the second contact, the latter being subjected to the action of a U-shaped magnetic structure that surrounds its support.

18. Switching device, wherein two switches according to claim 2 are series-mounted in the same circuit.

19. Switching device according to claim 18, wherein both switches have one same fixed contact located in the same sheath and two distinct mobile contacts.

20. Switching device according to claim 18, wherein both switches are laid out in parallel and have two mobile contacts that are electrically and mechanically coupled by a contact bridge.

21. Switching device according to claim 20, wherein these two switches are placed coaxially so that both sheaths move in opposite directions when opening.

22. An electric switch according to claim 1, wherein said first contact is a fixed contact and said second contact is a mobile contact.

23. An electric switch according to claim 13, wherein the magnetic core of the coil is coupled to a fixed contact which can withdraw parallel to the determined direction, so as to interrupt the contact with the second contact, the latter being subjected to the action of an energy accumulation device which is released by the movement of said core.

* * * * *